US006047563A

United States Patent [19]

DeRosa

[11] Patent Number: 6,047,563

[45] Date of Patent: Apr. 11, 2000

[54] EARRING WITH A TIE-LINE ATTACHED ORNAMENT

[76] Inventor: Vincent DeRosa, P.O. Box 3038, Huntington Station, N.Y. 11746

[21] Appl. No.: 08/986,526

[22] Filed: Dec. 8, 1997

[51] Int. Cl.[7] ..... A44C 7/00

[52] U.S. Cl. ..... 63/12; 63/13; 63/43; 132/273; D28/39

[58] Field of Search ..... 63/1.18, 12, 13, 63/14.2, 23, 43; 132/273, 275, 276, 278; D28/39, 41, 42, 43, 75

[56] References Cited

U.S. PATENT DOCUMENTS

| | | | |
|---|---|---|---|
| 188,323 | 3/1877 | Weed | 63/14.2 |
| D. 388,011 | 12/1997 | Leonard | D11/40 |
| 1,710,734 | 4/1929 | Johnson | 63/13 |
| 2,764,797 | 10/1956 | Carson | 63/1.18 |
| 3,689,758 | 9/1972 | Power | 240/6.4 W |
| 4,860,477 | 8/1989 | Gooch | 63/13 X |
| 5,167,245 | 12/1992 | Harriett | 132/273 |
| 5,404,892 | 4/1995 | Bretl | 132/200 |
| 5,526,654 | 6/1996 | Carter | 63/14.1 |
| 5,797,408 | 8/1998 | Wilson | 132/275 |
| 5,810,022 | 9/1998 | Reynolds | 132/200 |

*Primary Examiner*—Terry Lee Melius
*Assistant Examiner*—Andrea Chop
*Attorney, Agent, or Firm*—Myron Amer P.C.

[57] ABSTRACT

A lock of hair displayed in a vertical orientation that is attached to a string-like depending component of an earring using a slipknot in the string to engage the lock of hair, wherein the knot both holds the lock of hair in place and also compresses its girth so that the non-compressed girth above the knot prevents inadvertent disengaging descending movement through the knot.

1 Claim, 1 Drawing Sheet

FIG. 1
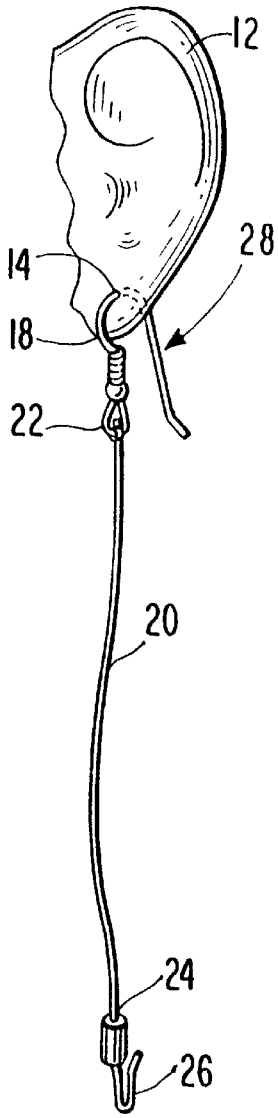
FIG. 2
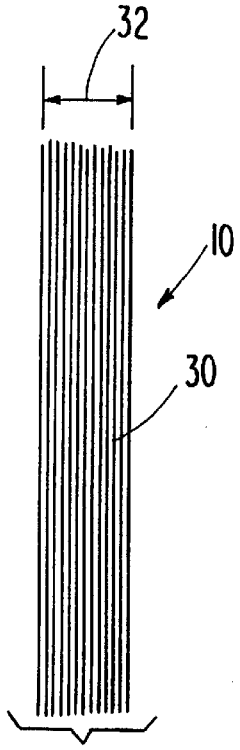
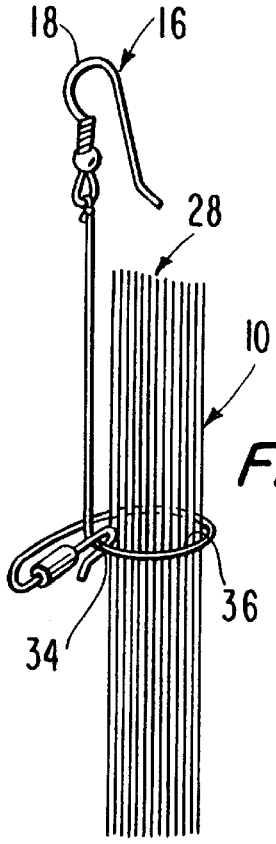
FIG. 3
FIG. 4
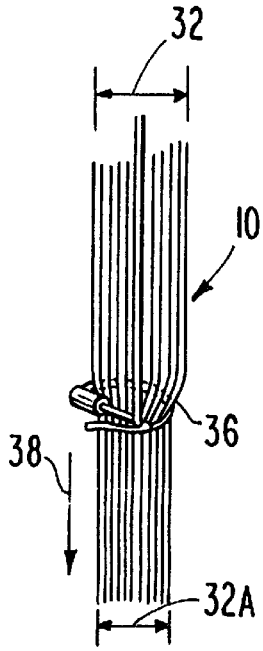

EARRING WITH A TIE-LINE ATTACHED ORNAMENT

The present invention relates generally to an earring having significant display value, and more particularly to an earring having a wide range of objects that can be supported on the earring to provide a correspondingly wide range of appearances to contribute to its display value.

BACKGROUND OF THE INVENTION

Field of the Invention

It is already well known from the prior patents that it is desirable to attach to the portion of an earring that is attached to a user's earlobe a variety of ornaments which provide different appearances, such prior patents being exemplified by U.S. Pat. No. 5,077,987 issued for "Interchangeable Earring Holder" to Edwin L. Leith, III on Jun. 7, 1992, and by U.S. Pat. No. 5,161,390 issued for "Interchangeable and Detachable Earring Assemblage" to Mina Sam on Nov. 10, 1992. The '390 patent achieves appearance variation by embodying structural features which enable attachment to a first decorative object, a second and successively attached additional decorative objects.

SUMMARY OF THE INVENTION

While somewhat noteworthy, the prior patents noted and all other such known patents are not believed to take full advantage of the display position of the earring decorative object, namely a position in which it extends in depending relation from the earring attached to the user's ear.

Broadly, it is an object of the present invention to provide an earring with a wide range of decoration possibilities overcoming the foregoing and other shortcomings of the prior art.

More particularly, it is object to match a decorative object characterized by a compressible girth which can readily be made to assume a vertical or depending orientation relative to the earring with the natural depending display position beneath the ear, so that the "vertical" object or ornament is displayed in the most advantageous display position, all as will be better understood as the description proceeds.

BRIEF DESCRIPTION OF THE DRAWINGS

The description of the invention which follows, together with the accompanying drawings should not be construed as limiting the invention to the example shown and described, because those skilled in the art to which this invention appertains will be able to devise other forms thereof within the ambit of the appended claims.

FIG. 1 is a perspective view, on a slightly enlarged scale, of a string component attached to a user's ear preparatory to further attachment to a lock of hair display;

FIG. 2 is a perspective isolated view of the lock of hair;

FIG. 3 is a perspective view of initial interengagement of the attachment of FIG. 1 with the lock of hair of FIG. 2; and FIG. 4 is a perspective view of a completed interengagement of the components of FIG. 3.

DESCRIPTION OF THE PREFERRED EMBODIMENT

As a decoration for an earring, use is made of an assemblage of hair which, in practice, would have sentimental value to the user, such as a lock of hair 10 of the head of a loved one, or from a pet, or even from a garment having sentimental value. In a preferred embodiment, a user's ear 12 is pierced, as at 14, and an ear-attaching means 16 is attached using a hook-like configuration 18 disposed through the lobe opening 14 and has a string 20 attached at 22 and thus presents a length portion of a recommended length of three and one quarter inches in depending relation from the hook 18 and ending in an opposite end 24 to which is attached a slipknot-tying hook 26. As used herein, the components 16, 20 and 26 constitute an earring, generally designated 28.

The loose assemblage of hair, generally designated 30 in FIG. 2 has a girth 32. The hair assemblage or lock of hair 30, as shown in FIG. 3, initially has the string 20 disposed in encircling relation about its uncompressed girth 32 with the string hook 26 engaged, as at 34, to the string 20. To complete the positioning for display purposes of the lock of hair 10 so as to constitute a lock of hair-decorated earring 28, the string 20 is drawn tight about the lock of hair 10 in much the same way that a slipknot is applied to an object, which compresses the girth 32 at the contact of the string 20 with the hair 10, as at 36 but, of course, has no compressing effect on the girth 32 above the contact site 36 such that this enlarged size girth obviates inadvertent slippage or unattaching descending movement 38 through the knot.

While the lock of hair-decorated earring herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A combination earring and a lock of hair display comprising an ear-attaching means on an earring adapted to be connected to an earlobe of a user, a single string attached at a first end to said ear-attaching means to present a length portion extending to a second end thereof, and said lock of hair display comprising an assemblage of plural strands of hair, each strand having opposite free ends, said assemblage of plural strands of hair being of a number in adjacent relation to each other so as to provide a compressible girth, a slip knot at said second end of said length portion of said string, an operative position of said assemblage of plural strands of hair disposed in a vertical orientation within said slip knot and means for tightening said slip knot about said assemblage of plural strands of hair, whereby said tightening of said slip knot compresses said girth of said lock of hair display for attachment in depending relation from said earring and an upper adjacent non-compressed girth of said assemblage of plural strands of hair prevents inadvertent unattaching descending movement through said slip knot.

* * * * *